US009116488B2

(12) United States Patent
Shinohara

(10) Patent No.: US 9,116,488 B2
(45) Date of Patent: Aug. 25, 2015

(54) IMAGE PROCESSING APPARATUS, DEVELOPER CARTRIDGE, AND IMAGE FORMING METHOD

(71) Applicant: c/o IP DIV., Toshiba Tec Corporation, Tokyo (JP)

(72) Inventor: Eiji Shinohara, Shizuoka (JP)

(73) Assignees: KABUSHIKI KAISHA TOSHIBA, Tokyo; TOSHIBA TEC KABUSHIKI KAISHA, Tokyo (JP)

( * ) Notice: Subject to any disclaimer, the term of this patent is extended or adjusted under 35 U.S.C. 154(b) by 52 days.

(21) Appl. No.: 13/797,482

(22) Filed: Mar. 12, 2013

(65) Prior Publication Data

US 2013/0236196 A1 Sep. 12, 2013

Related U.S. Application Data

(60) Provisional application No. 61/609,866, filed on Mar. 12, 2012.

(51) Int. Cl.

| | |
|---|---|
| ***G03G 15/00*** | (2006.01) |
| ***G03G 13/22*** | (2006.01) |
| ***G03G 15/08*** | (2006.01) |
| *G03G 21/16* | (2006.01) |

(52) U.S. Cl.

CPC ..... *G03G 15/5062* (2013.01); *G03G 13/22* (2013.01); *G03G 15/0863* (2013.01); *G03G 21/1657* (2013.01); *G03G 2215/209* (2013.01)

(58) Field of Classification Search

CPC ..... G03G 15/2064; G03G 2215/2074; G03G 9/093; G03G 9/09392; G03G 15/5062; G03G 15/0863

USPC ..... 399/68, 69, 400, 72

See application file for complete search history.

(56) References Cited

U.S. PATENT DOCUMENTS

| | | | | |
|---|---|---|---|---|
| 2004/0253006 | A1* | 12/2004 | Hayashi et al. | 399/12 |
| 2005/0141906 | A1* | 6/2005 | Murakami | 399/45 |
| 2006/0115283 | A1* | 6/2006 | Yamauchi et al. | 399/24 |
| 2008/0013970 | A1 | 1/2008 | Kikuchi | |
| 2009/0154970 | A1* | 6/2009 | Yoshida et al. | 399/341 |

FOREIGN PATENT DOCUMENTS

| | | |
|---|---|---|
| JP | 2010-244049 | 10/2010 |

* cited by examiner

*Primary Examiner* — Benjamin Schmitt

(74) *Attorney, Agent, or Firm* — Patterson & Sheridan, LLP

(57) ABSTRACT

An image processing apparatus has a sheet feeding unit that feeds sheets for printing, an image forming section that forms a developer image, including a developer supply section for supplying a developer a identification element that stores image forming information containing information about whether the accommodated developer is an erasable developer and arranged in the developer supply section, a identification element detecting unit that reads the image forming information from the identification element, and a control section that forms the image on the basis of the image forming information read from the identification element.

7 Claims, 8 Drawing Sheets

| TYPE | FIXING TEMPERATURE | DEVELOPER SUPPLEMENTING TIME | APPLIED VOLTAGE |
|---|---|---|---|
| ERASABLE | 150°C | 10 SEC | 240V |

IMAGE PROCESSING APPARATUS, DEVELOPER CARTRIDGE, AND IMAGE FORMING METHOD

CROSS-REFERENCE TO RELATED APPLICATION

This application is based upon and claims the benefit of priority from U.S. Provisional Patent Application No. 61/609,866, filed on Mar. 12, 2012; the entire contents of which are incorporated herein by reference.

FIELD

Embodiments described herein relate to an image processing apparatus, a developer cartridge, and an image forming method.

BACKGROUND

There exists an image processing apparatus wherein, in order to realize resource conservation, an erasable developer is used to form an image on a sheet, and, after use of the sheet, the image on the sheet is erased by an erasing device. However, an issue arises when using an erasable developer, in that different lots of developer may have different appropriate values for the fixing temperature and the voltage applied on the photosensitive drum, as well as a different threshold temperature for erasing the image.

To address these variables, there has been proposed using correction values stored in a memory in the toner cartridge, and, when the image is formed, the correction values are read and applied to correct the fixing temperature, the voltage applied on the photosensitive drum, etc.

However, with this technology, no consideration is made for the erasable developer, and it is impossible to modify the erasing temperature.

Consequently, there is a need for an image processing apparatus, a developer cartridge, and an image forming method that can correct the image forming conditions and the image erasing conditions related to the use of erasable developer.

DETAILED DESCRIPTION

In general, according to one embodiment, the image processing apparatus, the developer cartridge and the image forming method will be explained in detail with reference to the drawings.

As an embodiment of the present disclosure, there is provided an image processing apparatus having a sheet feeding unit that feeds sheets, an image forming section that forms developer image including a developer supply section for supplying a developer, a identification element that stores the image forming information containing the information about whether the developer accommodated in the developer supply section is an erasable developer, a identification element detecting unit that reads the image forming information from the identification element, and a control section that forms the image on the basis of the image forming information read from the identification element.

The image processing apparatus of the present embodiment has a sheet feeding unit that feeds sheets, an image forming section that forms the developer image, including a developer supply section for supplying a developer, a identification element that stores the image forming information containing information about whether the developer accommodated in the developer supply section is an erasable developer, a identification element detecting unit that reads the image forming information from the identification element, and a control section that forms the image on the basis of the image forming information read from the identification element.

Figure 1:
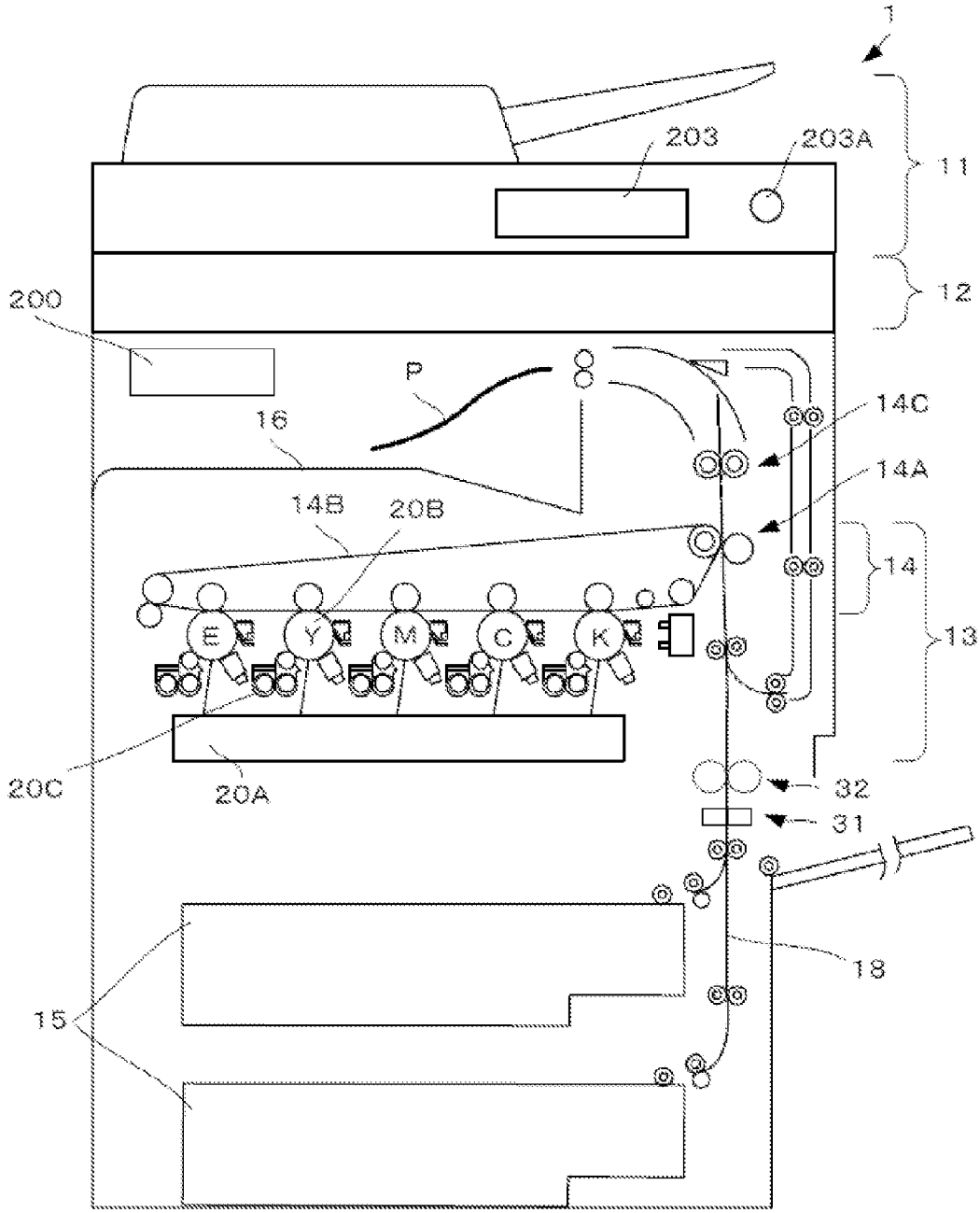
FIG. 1 is a diagram illustrating the configuration of the image processing apparatus.

FIG. 1 is a diagram illustrating the configuration of an image processing apparatus 1 in this embodiment. As shown in FIG. 1, the image processing apparatus 1 has a control section 200, a control panel 203, a start button 203A, an automatic original feeding device 11, an image reading section 12, an image forming section 13, a transcribing section 14, a sheet transporting passage 18, a sheet feeding unit 15, a reading section 31, and an erasing section 32.

For example, the control panel 203 has a touch panel as the input/output section for displaying a graphical user interface.

When the start button 203A is pressed, a signal indicating the start of an image forming session is sent to the control section 200.

The automatic original feeding device 11 is arranged in a free opening/closing manner on the upper side of the main body of the image processing apparatus 1. The automatic original feeding device 11 has an original document or sheet transporting mechanism that fetches the original sheets, one sheet at a time, from a sheet feeding tray, and transports the original to a sheet discharge tray.

The automatic original feeding device 11 uses its original transporting function to transport each original sheet to the original reading section of the image reading section 12. Here, one may also adopt a scheme in which the automatic original feeding device 11 is opened and the original is set on the original table of the image reading section 12.

The image reading section 12 has a carriage equipped with an exposure lamp for exposure of the original and a first reflective mirror, plural second reflective mirrors that can be driven to move corresponding to the movement of the carriage, a lens block, and a CCD (Charge Coupled Device) of the image reading sensor, as are known in the art.

The carriage is at still in the original reading section or it is driven to make reciprocal movement below the original table, and the light of the exposure lamp reflected from the original is reflected by the first reflective mirror. Then, the light reflected from the first reflective mirror is reflected by the plural second reflective mirrors to the lens block. The lens block then changes the magnification rate of the reflected light, and then outputs it to the CCD. The CCD converts the incident light to an electric signal that is then output as an image signal to the image forming section 13.

Referring to the image forming section of the apparatus shown in FIG. 1, for each of the yellow developer Y, magenta developer M, cyan developer C, black developer K, and erasable developer E, the image forming section 13 has a laser irradiating unit 20A, a photosensitive drum 20B as the image carrier, a developer feeding unit 20C and the transcribing section 14, respectively. Here, the developer feeding unit has a developer cartridge 201 (FIG. 3) containing the developer and arranged in a quick connecting/disconnecting way, which also functions to feed the developer.

The erasable developer contains coloring compound, developing agent, and decoloring agent. The coloring compound is, e.g., a leuco dye. The developing agent is, e.g., one or more phenol compounds. The decoloring agent is a substance that is miscible with the coloring compound when heated, and it has no affinity to the developing agent.

The erasable developer works as follows: coloration takes place due to the reaction between the coloring compound and the developing agent to form bonds therebetween resulting in a colored combined or bonded developer-ink compound, but when the developer-ink compound is heated to above the decoloring temperature, the bonds between the coloring compound and the developing agent are broken, and the developer will bond or bind with an erasing reagent, resulting in the image becoming clear or un-colored.

The laser irradiating unit 20A has a laser beam irradiated on the photosensitive drum 20B on the basis of an image signal corresponding to an image on an original sheet read in the reading section to form an electrostatic latent image on the photosensitive drum 20B. The developer feeding unit 20C feeds the developer to the photosensitive drum 20B to form a developer image from the electrostatic latent image.

The sheet feeding unit 15 fetches the sheets, one at a time, from the sheet feeding cassette and transports the sheet to the sheet transporting passage. The sheet transporting passage transports the sheet to the transcribing section 14.

The transcribing section 14 has a transcribing belt 14B and a transcribing roller 14A. The transcribing belt 14B receives the developer image from the photosensitive drum 20B thereon and carries the image on the belt to the transcribing roller 14A. The transcribing roller 14A applies a voltage and transfers the developer image carried on the transcribing belt onto the transported sheet.

The image processing apparatus 1 has a fixing device 14C located downstream of the transcribing roller 14A in the sheet transporting direction of the transcribing section 14. The fixing device 14C fixes the developer image on the sheet using heat and pressure.

The sheet P discharged from the sheet discharging port is stacked on top of any prior printed sheets in the sheet discharge tray 16

The image processing apparatus 1 has a read section 31 arranged downstream in the sheet transporting direction of the sheet feeding unit 15 while upstream in the sheet transporting direction of the transcribing section 14, and an erasing section 32 arranged downstream in the sheet transporting direction of the read section 31 while upstream in the sheet transporting direction of the transcribing section 14.

The read section 31 has a scanner for reading the image on both sides of the sheet. The image processing apparatus 1 determines a quality of the sheet, in particular whether there is an image on the sheet, by use of the read section 31. The image processing apparatus 1 can temporarily store the image read by the read section 31 in a RAM or other memory.

The erasing section 32 has a pair of erasing devices arranged at positions facing each other with the sheet transporting passage 18 sandwiched between them. The erasing devices each have a heating section for heating the sheet to a temperature above the temperature needed to erase an image on the sheet, the temperature determined based on a quality of the sheet, in particular an indicia of the properties of the developer used to print the image. In the erasing mode, the image processing apparatus 1 heats the sheet transported through the erasing section 32 to above the erasing temperature of the image thereon to erase the image formed from the erasable developer on the sheet.

Figure 2:
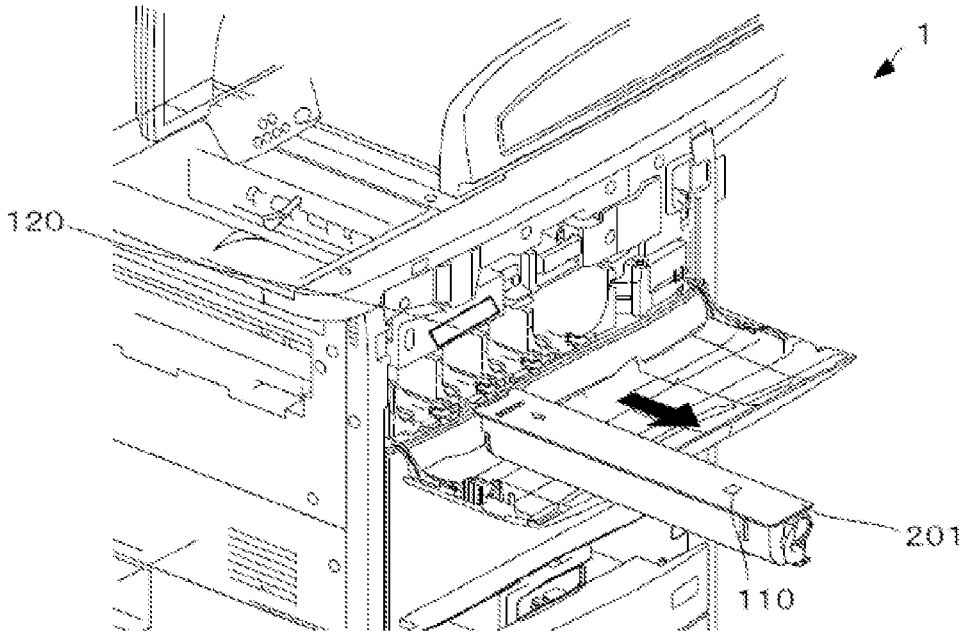
FIG. 2 is a diagram illustrating the state of the image processing apparatus after the developer cartridge is extracted from the image processing apparatus.

FIG. 2 is a diagram illustrating the state of the image forming apparatus after developer cartridges 201 are extracted from the image processing apparatus 1. The developer cartridge 201 shown in FIG. 2 contains developer therein, and developer cartridge 201 is installed in the image processing apparatus 1 by sliding it into a contoured opening to the image processing apparatus 1.

The developer cartridge 201 has an identification element therewith that shows the type of the developer disposed therein. An example, the identification element is a wireless tag 110. However, the present disclosure is not limited thereto, and other identifying elements, including re-writable elements having memory, or specific use cartridges having a permanent indicia, and such cartridges will require refilling by developer have the same properties of a developer previously present in the cartridge, are specifically contemplated.

The image processing apparatus 1 has an identification element detecting device that detects the type of the developer cartridge 201 on the basis of the identification element.

When the developer cartridge 201 has the wireless tag 110 as the identification element, the image processing apparatus 1 has a reader/writer 120 as the identification element detecting device. This reader/writer can read/write data from/to the wireless tag 110 at the position in the image processing apparatus 1 where it can carry out communication with the wireless tag 110.

The types of information accommodated in the wireless tag 110 include, e.g., the information related to yes/no of decoloration ability of the developer, the information related to the type of the non-decoloring developer, the information related to the color, the information related to the use history, the developer cartridge identification information, such as the lot number, etc., the image forming information, such as the fixing temperature, the developer replenishment time, the voltage applied on the photosensitive drum, or other indicia of a property of the developer and a property of the image, such as the conditions required to erase an image formed with the developer.

The wireless tag 110 may also accommodate the correction value of the fixing temperature, the correction value of the developer replenishment time, and the correction value of the voltage applied on the photosensitive drum instead of the fixing temperature, developer replenishment time and the voltage applied on the photosensitive drum, the correction values being calibrated to a standard value known or stored in the image processing unit.

When the developer is an erasable developer, the wireless tag 110 also records the temperature of the developer required to erase an image formed using the developer.

Figure 3:
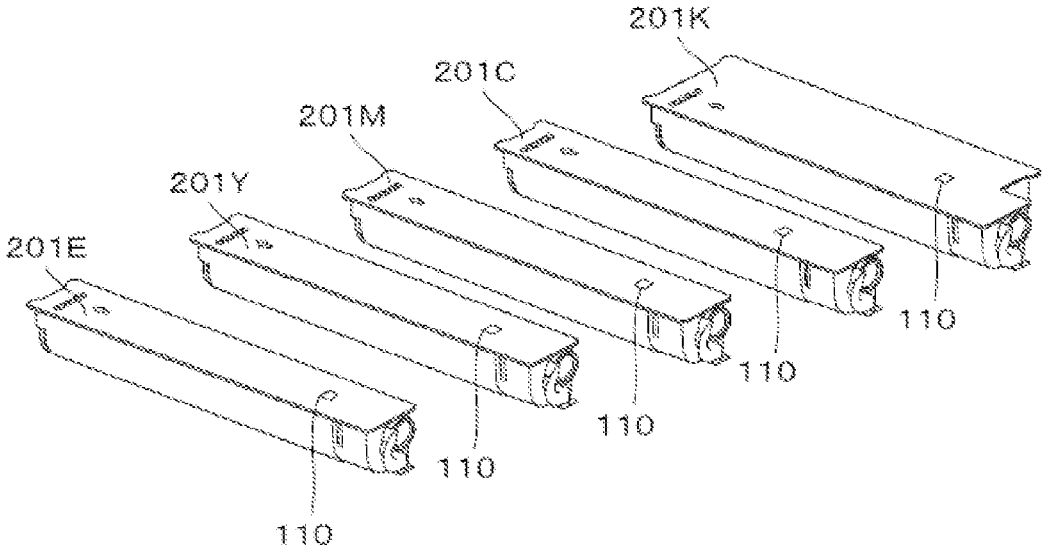
FIG. 3 is a diagram illustrating an example of a developer cartridge used with the image processing apparatus.

FIG. 3 is a diagram illustrating an example of the developer cartridge 201. As shown in FIG. 3, the developer cartridge identification elements written or stored in the wireless tag 110 are specific information unique to the erasable type and the non-erasable type of developer, as well as, properties of the developer in the yellow developer cartridge 201Y, the magenta developer cartridge 201M, the cyan developer cartridge 201C, and the black developer cartridge 201K.

Figure 4:
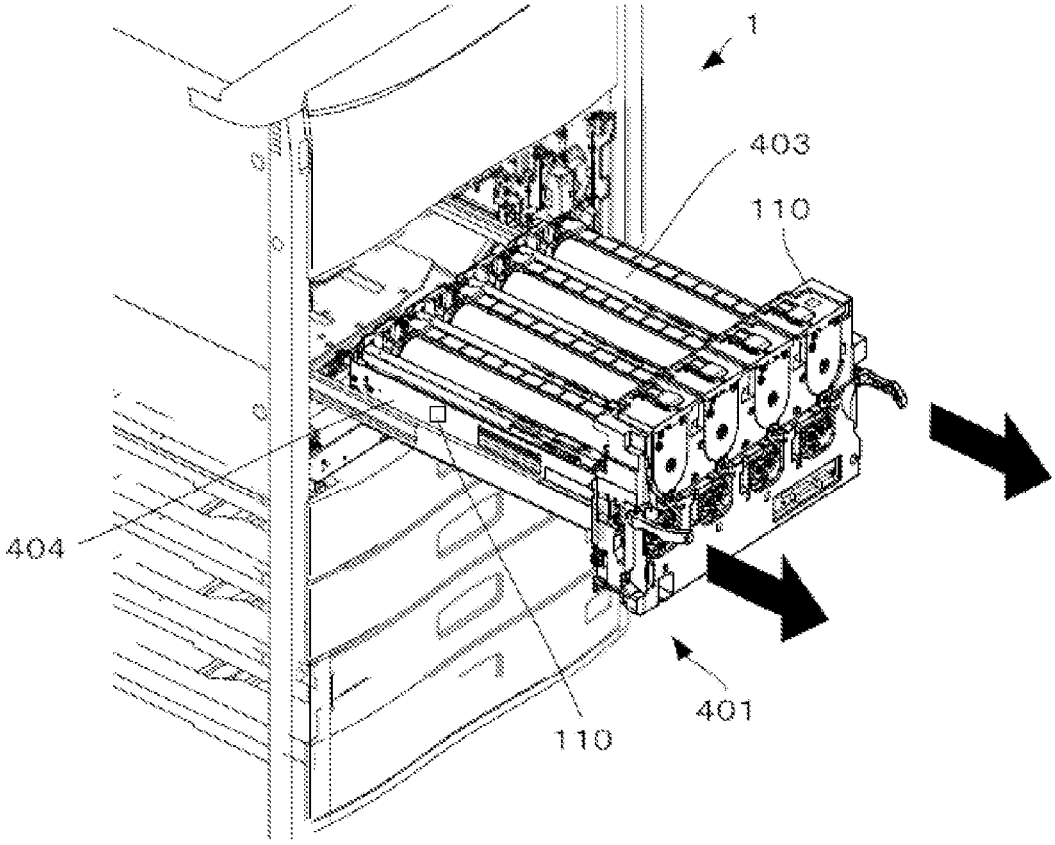
FIG. 4 is a diagram illustrating the state of the image processing apparatus after the process unit is extracted from the image processing apparatus.

FIG. 4 is a diagram illustrating the state when a process unit 401 having the radiating unit 20A, photosensitive drum, 20B and developer feeding unit 20C therein, is extracted from the image processing apparatus 1. As shown in FIG. 4, the process unit 401 has a photosensitive drum unit 403 within which the individual drums 20B are situated as the image carrier, a developing unit 404 for feeding the developer to the photosensitive drum unit 403, and a identification element located therewith and adopted for identifying the type of the developer in use.

The identification element may be the wireless tag 110. However, the present disclosure is not limited thereto.

The image processing apparatus 1 has an identification element detecting device that detects the type of the developer corresponding to the identification element located on or in the developing unit 404 on the basis of the identification element.

When the developing unit 404 has the wireless tag 110 as the identification element, the image processing apparatus 1 has the reader/writer 120 as the identification element detecting device that can read/write the wireless tag 110 at the position in the image processing apparatus 1 where it is possible to carry out communication with the wireless tag 110. The unit shown above in FIG. 3 may be adopted concurrently as the reader/writer 120.

For example, the wireless tag 110 accommodates the following information: the information related to decolorable/non-decolorable developer, the information related to the color, the information related to the use history, the lot number and other developer identification information.

The wireless tag 110 accommodates the image forming information related to the fixing temperature, the developer replenishment time, the voltage applied on the photosensitive drum, etc.

The wireless tag 110 may also accommodate the correction value of the fixing temperature, the correction value of the developer replenishment time, and the correction value of the voltage applied on the photosensitive drum instead of the fixing temperature, the developer replenishment time and the voltage applied on the photosensitive drum.

The wireless tag 110 also accommodates the decoloration temperature when the developer is an erasable developer.

When the structure has the developing unit 404 or the photosensitive drum unit 403 separated from the process unit 401, the wireless tag 110 as an identification element may be arranged in the developing unit 404 and the photosensitive drum unit 403.

Figure 5:
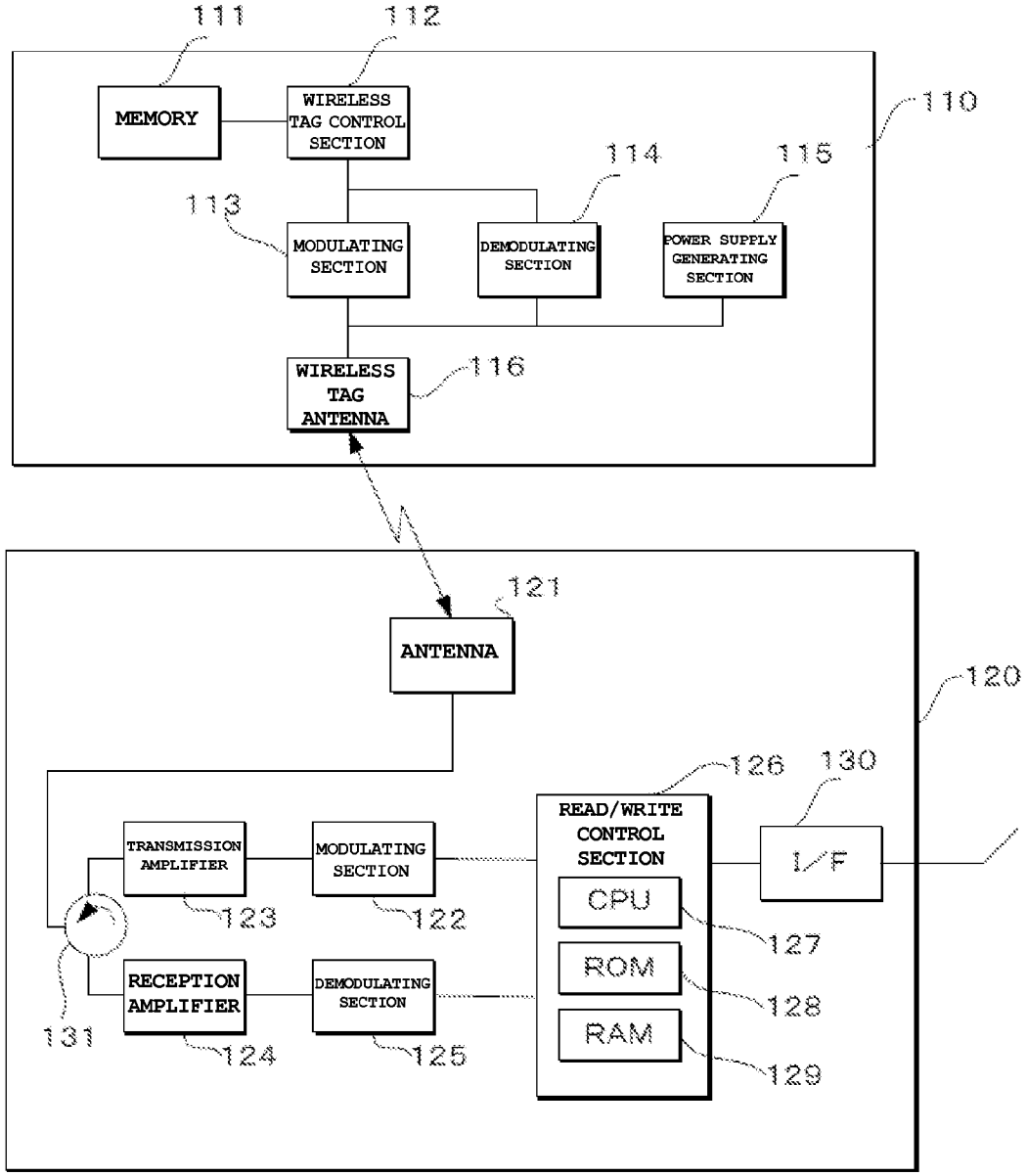
FIG. 5 is block diagram illustrating the configuration of a wireless tag and the reader/writer.

FIG. 5 is a block diagram illustrating the configuration of the wireless tag 110 and the reader/writer 120. As shown in FIG. 5, the wireless tag 110 has a memory 111 as the memory device, a wireless tag control section 112 that carries out read/write of data in the memory 111, a power supply generating section 115 that supplies power by carrying out rectification and stabilization of the received modulated electromagnetic wave, a wireless tag antenna 116 for transmission/reception of the signal, a modulating section 113 that modulates the data output from the wireless tag control section 112 and sends the obtained data to the wireless tag antenna 116, and a demodulating section 114 that demodulates the received modulated electromagnetic wave and sends the obtained signal to the wireless tag control section 112.

The reader/writer 120 has a read/write control section 126 that controls the communication with the wireless tag 110 and controls the various hardware units connected with it, a modulating section 122 that modulates the signal output from the read/write control section 126, a transmission amplifier 123 that amplifies the modulated signal and sends the amplified signal via a circulator 131 to the antenna 121, a reception amplifier 124 that amplifies the modulated electromagnetic wave received from the each antenna via the circulator 131, a demodulating section 125 that demodulates the received modulated signal, and an interface 130 that is connected to the control section of the image processing apparatus 1 and carries out data exchange. Here, the read/write control section 126 has a CPU 127, and a ROM 128 as well as a RAM 129 for accommodating the data.

Figures 6, 7:
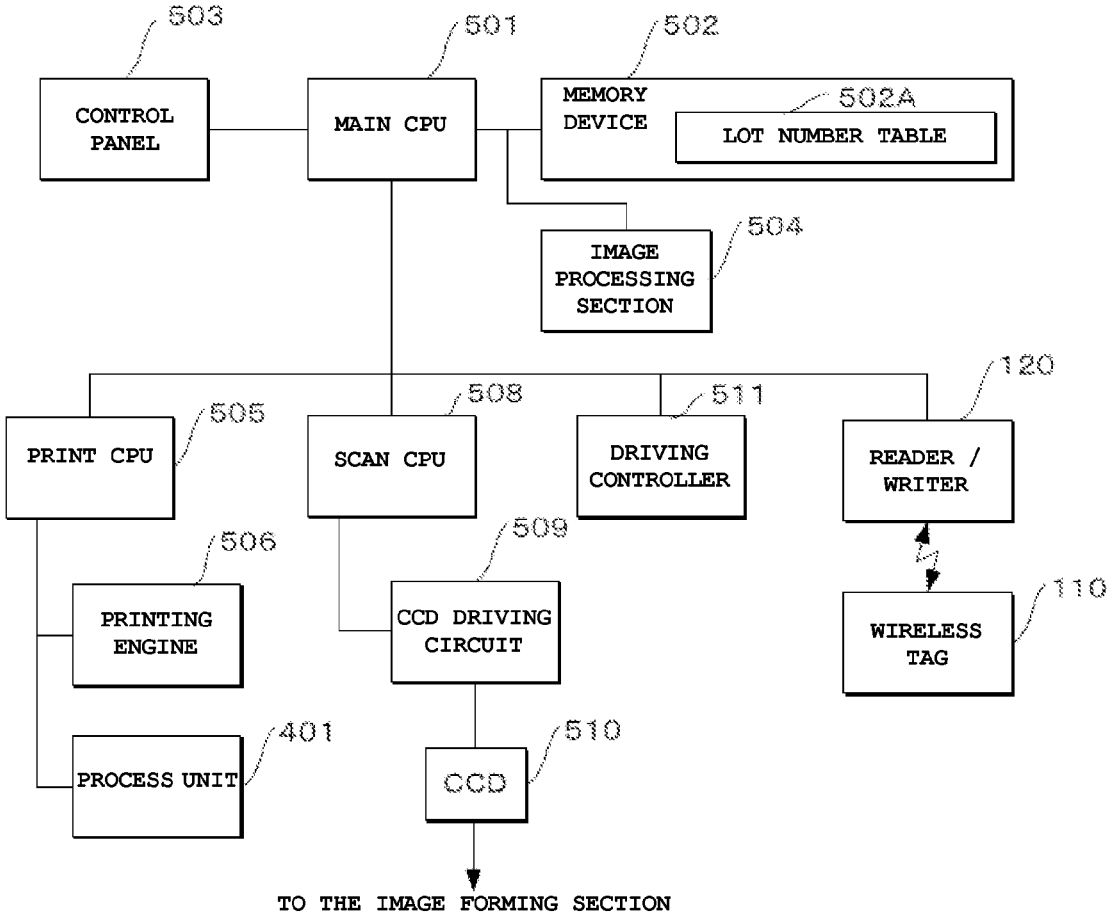
FIG. 6 is a block diagram illustrating the configuration of the image processing apparatus.
FIG. 7 is a diagram illustrating an example of the data accommodated in the identification element.

FIG. 6 is a block diagram illustrating the configuration of the image processing apparatus 1. As shown in FIG. 6, the image processing apparatus 1 has a main CPU 501 as the control section, a control panel 503 as the input device, a memory device 502, such as ROM, RAM, etc., and an image processing section 504 that carries out image processing.

The main CPU 501 is connected to the following parts equipped in the image processing apparatus 1 to control them: a print CPU 505, a scan CPU 508, a driving controller 511 and the reader/writer 120.

The print CPU 505 controls the following parts connected to it: a printing engine 506 that carries out image formation, and the process unit 401 containing a transcribing device.

The scan CPU 508 controls the CCD driving circuit 509 that drives the CCD 510. The output of the CCD 510 is output to the image forming section.

The driving controller 511 controls the recording media transporting mechanism (not shown).

The memory device 502 has the lot number table 502A that accommodates the decoloration temperature for each lot number of the erasable developer.

FIG. 7 is a diagram illustrating an example of the data accommodated in the identification element. As shown in FIG. 7, the identification element accommodates the "type" indicating the type of the developing material, the "fixing temperature" as the fixing temperature of the developing material, the "developer replenishment time" indicates the time duration for carrying out supplementing of the developing material, the "applied voltage" is the voltage applied on the photosensitive drum and the bias voltage of the photosensitive drum.

As an example of the various data, the type is "erasable", the fixing temperature is "150° C.", the developer replenishment time is "10 sec", and the applied voltage is "240 V".

Figure 8:
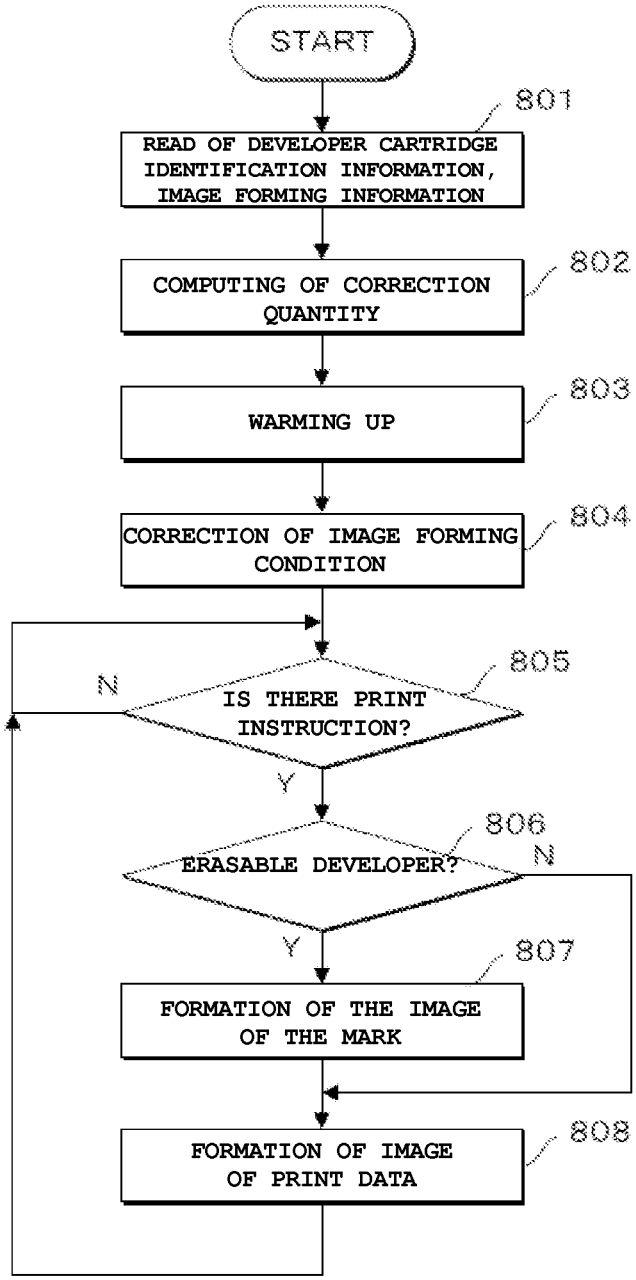
FIG. 8 is a diagram illustrating the image forming operation of the image processing apparatus.

FIG. 8 is a diagram illustrating the image forming operation of the image processing apparatus 1. As shown in FIG. 8, in step 801, the image processing apparatus 1 reads the developer cartridge identification information or developer identification information and the image forming information from the identification element.

In step 802, the image processing apparatus 1 computes the correction value of the image forming information. This correction value is computed by determining the difference between the value of the current image forming information and the value of the image forming information read from the identification element.

In step 803, the image processing apparatus 1 carries out warming up to heat up the temperature of the fixing device 14C to the fixing temperature.

In step 804, the image processing apparatus 1 corrects the image forming condition by the computed correction value.

In step 805, the image processing apparatus 1 determines whether there is a print instruction. When the image processing apparatus 1 determines there exists the print instruction, it goes to step 806. On the other hand, if it is determined that there is no print instruction, it returns to step 805.

In step 806, the image processing apparatus 1 determines whether the type of the developer is an erasable developer. If the image processing apparatus 1 determines that the type of the developing material is an erasable developer, it goes to step 807. If it does not determine the type of the developing material is an erasable developer, it goes to step 808.

In step 807, the image processing apparatus 1 forms an image with a mark indicating formation of the image by an erasable developer and the lot number of the developer read from the identification element in yellow color or other color that does not stand out.

In step 808, the image processing apparatus 1 forms the image from the print data on the sheet, and it then returns to step 805.

Figure 9:
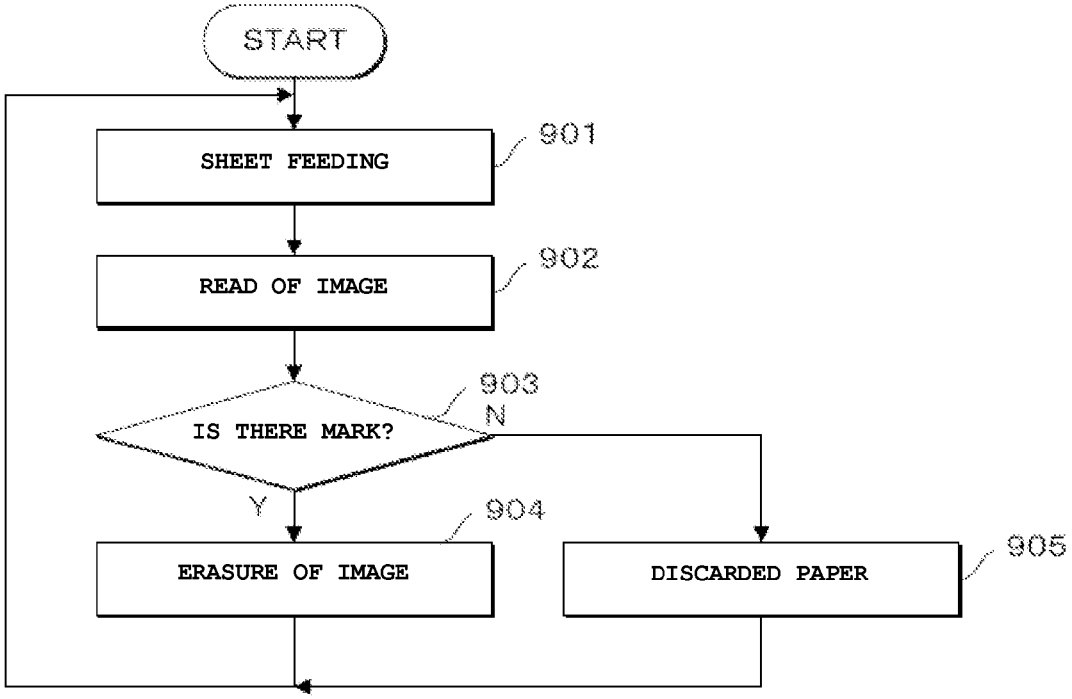
FIG. 9 is a diagram illustrating the decoloration operation of the image processing apparatus.

FIG. 9 is a diagram illustrating the decoloration operation of the image processing apparatus 1. As shown in FIG. 9, in step 901, the image processing apparatus 1 feeds sheets one at a time.

In step 902, the image processing apparatus 1 reads the images on the sheet by the read section 31. More specifically, it reads the mark and the lot number.

In step 903, the image processing apparatus 1 determines whether there is a mark formed as an image which was made using erasable developer. If the image processing apparatus 1 determines that there is the mark, it goes to step 904. On the other hand, if it does not determine that there is a mark, it goes to step 905.

In step 904, the image processing apparatus 1 uses the erasing section 32 to erase the image on the sheet at the erasing temperature read from the identification element, and it then returns to step 901.

In step 905, the image processing apparatus 1 carries out expulsion of the sheet as a discarded sheet, and it then returns to step 901.

Figure 10:
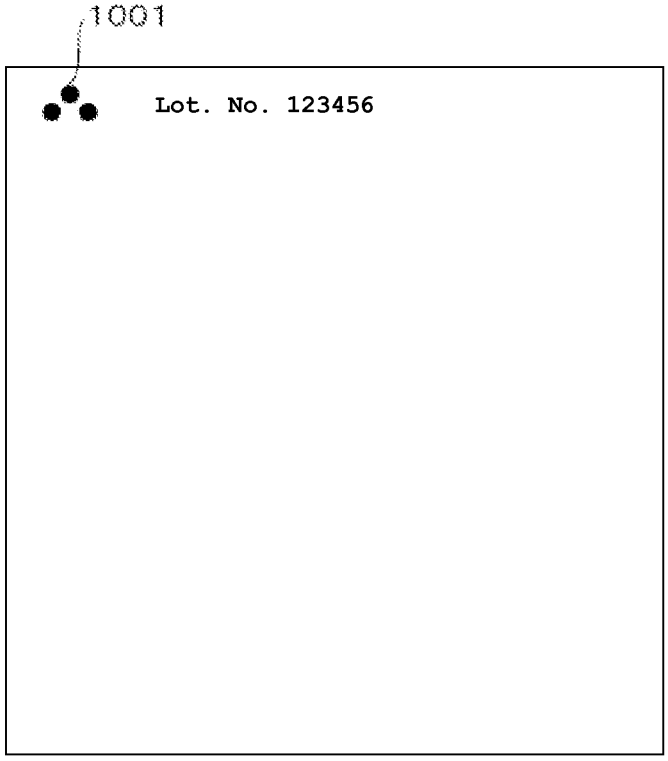
FIG. 10 is a drawing illustrating an example of a mark.

FIG. 10 is a diagram illustrating an example of the mark. As shown in FIG. 10, when the developer that forms the image is an erasable developer, the image processing apparatus 1 forms the mark 1001 and the lot number as image on the sheet.

As explained above, the image processing apparatus 1 has a sheet feeding unit 15 that feeds the sheet, the image forming section 13 that has a developer feeding section that feeds the developer and that forms the developer image, a identification element, which is arranged in the developing material feeding section and which stores the image forming information of the developer when the accommodated developer is an erasable developer, a identification element detecting unit that reads the image forming information from the identification element, and a control section that forms the image on the basis of the image forming information read from the identification element.

Consequently, it can display an effect that it is possible to correct the image forming condition also for the erasable developer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing apparatus comprising:

a sheet feeding unit that feeds a sheet;

an image forming section that forms a developer image on the sheet and includes a developer supply section that supplies a developer;

an identification element that is provided in the developer supply section which stores image forming information including at least information indicating whether or not the developer is an erasable developer and identification information of the developer supply section;

an identification element detecting unit that reads the image forming information from the identification element; and a control section configured to control the image forming section to print, on a sheet, a mark indicating that the image on the sheet is formed with an erasable developer and an image portion indicating the identification information of the developer supply section when the image forming information read from the identification element indicates that the developer is an erasable developer, wherein the identification information includes a lot number of the developer supply section.

2. The image processing apparatus according to claim 1, wherein the image forming information further includes at least one of a fixing temperature, a developer replenishment time, and a voltage applied to a photosensitive drum.

3. The image processing apparatus according to claim 1, further comprising:

a read section that reads the mark on the sheet;

an erasing section that heats the sheet, wherein the control section is further configured to determine whether or not the image on the sheet is formed with an erasable developer based on the read mark and control the erasing section to heat the sheet above a decoloration temperature of the erasable developer.

4. The image processing apparatus of claim 1, wherein the identification element is rewritable.

5. An image forming method comprising:

reading information indicating whether or not a developer used to form an image is an erasable developer and identification information of a developer supply section that supplies the developer, from an identification element provided in the developer supply section; and printing, on a sheet, a mark indicating that an image on the sheet is formed with an erasable developer and an image portion indicating the identification information of the developer supply section when the read image forming information indicates that the developer is an erasable developer, wherein the image forming information includes a fixing time, a developer replenishing time, and a voltage to apply to a photosensitive drum.

6. The image forming method according to claim 5, further comprising:

reading the mark on the sheet;

determining that the image on the sheet is formed with an erasable developer based on the read mark; and heating the sheet above a decoloration temperature of the erasable developer of the image.

7. The image forming method of claim 6, wherein the identification element is rewritable.

* * * * *